US009424820B2

(12) United States Patent
Jackson

(10) Patent No.: US 9,424,820 B2
(45) Date of Patent: Aug. 23, 2016

(54) TRANSFORMABLE STAND WITH AN IMPROVED FOOT OPERATED PITCH CHANGING MECHANISM FOR STRINGED INSTRUMENTS

(71) Applicant: David H. Jackson, Dahlonega, GA (US)

(72) Inventor: David H. Jackson, Dahlonega, GA (US)

( * ) Notice: Subject to any disclaimer, the term of this patent is extended or adjusted under 35 U.S.C. 154(b) by 0 days.

(21) Appl. No.: 14/332,358

(22) Filed: Jul. 15, 2014

(65) Prior Publication Data

US 2016/0019871 A1 Jan. 21, 2016

(51) Int. Cl.
*G10D 3/14* (2006.01)

(52) U.S. Cl.
CPC ..... *G10D 3/143* (2013.01)

(58) Field of Classification Search
USPC ..... 84/312 P
See application file for complete search history.

(56) References Cited

U.S. PATENT DOCUMENTS 3,422,716 A * 1/1969 Alifano ..... G10D 3/143 84/312
3,440,920 A * 4/1969 Norwood ..... G10D 3/143 94/312
3,688,631 A * 9/1972 Jackson ..... G10D 1/08 84/312
4,077,296 A * 3/1978 Mullen ..... G10D 3/14 74/526
4,080,864 A * 3/1978 Jackson ..... G10D 3/143 84/312
4,106,387 A * 8/1978 Alifano ..... G10D 3/14 84/312
6,002,075 A * 12/1999 Carter ..... G10D 3/143 84/312
7,247,779 B2 * 7/2007 Zumsteg ..... G10D 3/143 84/312

* cited by examiner

*Primary Examiner* — Christopher Uhlir
(74) *Attorney, Agent, or Firm* — Buche & Associates, P.C.; John K. Buche; Bryce A. Johnson

(57) ABSTRACT

Disclosed are apparatus and related methods for changing the pitch of a stringed instrument, such as an standard, fixed-pitch, resonating or Dobro-type guitar, by attaching the stringed instrument onto a transformable stand comprising a foot pedal assembly and string pitch changing mechanism. In one embodiment, the apparatus and related methods involve affixing the strings from an existing guitar to an improved pitch-changing mechanism, such as disclosed string pitch changer housing, that does not require the deconstruction of the guitar body. Rather, the existing guitar is securely placed on its back on a transformable stand with the use of specially designed plates that hold the instrument with screws, securing the body of the instrument to the stand.

13 Claims, 18 Drawing Sheets

STRING IN LOW SLOT-W/ LEVER PULL

STRING IN LOW SLOT-W/ NO LEVER PULL

STRING IN LOW SLOT

LEVER PULL DECREASES STRING TENSION TO LOWER PITCH

STRING IN HIGH SLOT

LEVER PULL INCREASES STRING TENSION TO RAISE PITCH

STRING IN HIGH SLOT-W/ LEVER PULL

STRING IN HIGH SLOT-W/ NO LEVER PULL

TRANSFORMABLE STAND WITH AN IMPROVED FOOT OPERATED PITCH CHANGING MECHANISM FOR STRINGED INSTRUMENTS

CROSS-REFERENCE TO RELATED APPLICATIONS

Not Applicable

STATEMENT REGARDING FEDERALLY SPONSORED RESEARCH OR DEVELOPMENT

Not applicable.

FIELD OF INVENTION

The disclosed subject matter is in the field of guitar effects. More specifically, this subject matter includes improvements to pedal or lever operated mechanisms that change the pitch of an instrument's string by raising and/or lowering its tension.

BACKGROUND OF THE INVENTION

Stringed instruments, like guitars, make sounds when a string vibrates. The pitch of a vibrating string's sound is dependent on many things, including the string's thickness, tension strength, and length. Thus, stringed instruments create a range of sound pitch via varying such physical characteristics of their strings.

Guitars typically have a preset pitch range that is determined by suspending a plurality of strings between the pegs, tuning keys or fine pitch changers at the end (keyhead) of a guitar's neck and the guitar's bridge. Some musicians seek to alter the preset pitch range of a guitar. However, in order to manually change the pre-determined pitch range on a guitar, the strings must be individually tuned by physically tightening or loosening the pegs, tuning keys or fine pitch changers. This manual tuning is usually too awkward and time consuming to be done during a performance and as a result, the performer is limited to single pitch range during the duration of the musical performance with any single instrument.

Pitch-changing mechanisms for stringed instruments are known. See, e.g., Fender: U.S. Pat. No. 3,352,188 A, Fender: U.S. Pat. No. 2,973,682 A, and Franklin: U.S. Pat. No. 4,704,935. For instance, pedal steel guitars are stringed musical instruments wherein the pitch of one or more strings may be manipulated via the movement of pedals or levers which are mechanically linked to the end of the strings to effectively slacken or tauten the string. With the advent of pitch-changing mechanisms, such as those used by a pedal steel guitar, the pitch of strings on a stringed instrument can be easily manipulated, up and/or down. In the case of the pedal steel guitar, the ability to mechanically change the pitch of a string by pressing a foot pedal or knee lever provides a wider range of pitches to musicians without tedious and time-consuming tuning.

Although capable of seamlessly adjusting the pitch of a stringed instrument, such pitch-changing mechanisms are often complex and cannot be utilized with a regular guitar. Actually, present pitch-changing mechanisms, such as those in a pedal steel guitar, must typically be built-in physical components of the instrument. As a result, current pitch-changing mechanisms cannot be utilized by an ordinary guitar without destructive modification. Stated differently, traditional guitars cannot be played like a pedal steel guitar without permanent modification. As a result, musicians who desire to incorporate the unique sounds of a pedal steel guitar with the sounds of a traditional, fixed-pitch guitar would need access to both (1) a pedal steel guitar and (2) a regular fixed-pitch guitar.

In view of the foregoing, a need exists for a pitch changing mechanism that transforms an existing fixed-pitch guitar into an instrument with pedal-activated pitch changing capabilities without destructive modifications. Thus, with the disclosed improvements described herein, existing guitars can be easily converted to a pitch-changing device and vice versa without professional installation through the use of a transformable stand, foot pedal assembly, and a string pitch changer.

BRIEF SUMMARY OF THE INVENTION

Disclosed are apparatus and related methods for changing the pitch of a stringed instrument, such as a standard, fixed-pitch, resonating or Dobro-type guitar, by attaching the stringed instrument onto a transformable stand comprising a foot pedal assembly and string pitch changing mechanism. In one embodiment, the apparatus and related methods involve affixing the strings from an existing guitar to an improved pitch-changing mechanism, such as disclosed string pitch changer housing, that does not require the deconstruction of the guitar body. Rather, the existing guitar is securely placed on its back on a transformable stand with the use of specially designed plates that hold the instrument with screws, securing the body of the instrument to the stand.

The guitar strings are routed across a replacement roller nut and roller bridge and connected to the string pitch changer mechanism that is operated by the foot pedal mechanism. In use, the placement of pressure on the pedals results in the pitch changing capabilities of the guitar.

BRIEF DESCRIPTION OF THE DRAWINGS

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF THE DRAWINGS

Disclosed are preferred embodiments of an improved pitch-changing apparatus and method for retrofitting the pitch-changing apparatus to existing stringed musical instruments. More particularly, disclosed are pitch-changing apparatus and related methods for existing stringed instruments via a pedal mechanism for raising and lowering the pitch of the individual strings of a stringed musical instrument. The details of the disclosed tuning apparatus are disclosed with reference to the figures.

Figure 1:
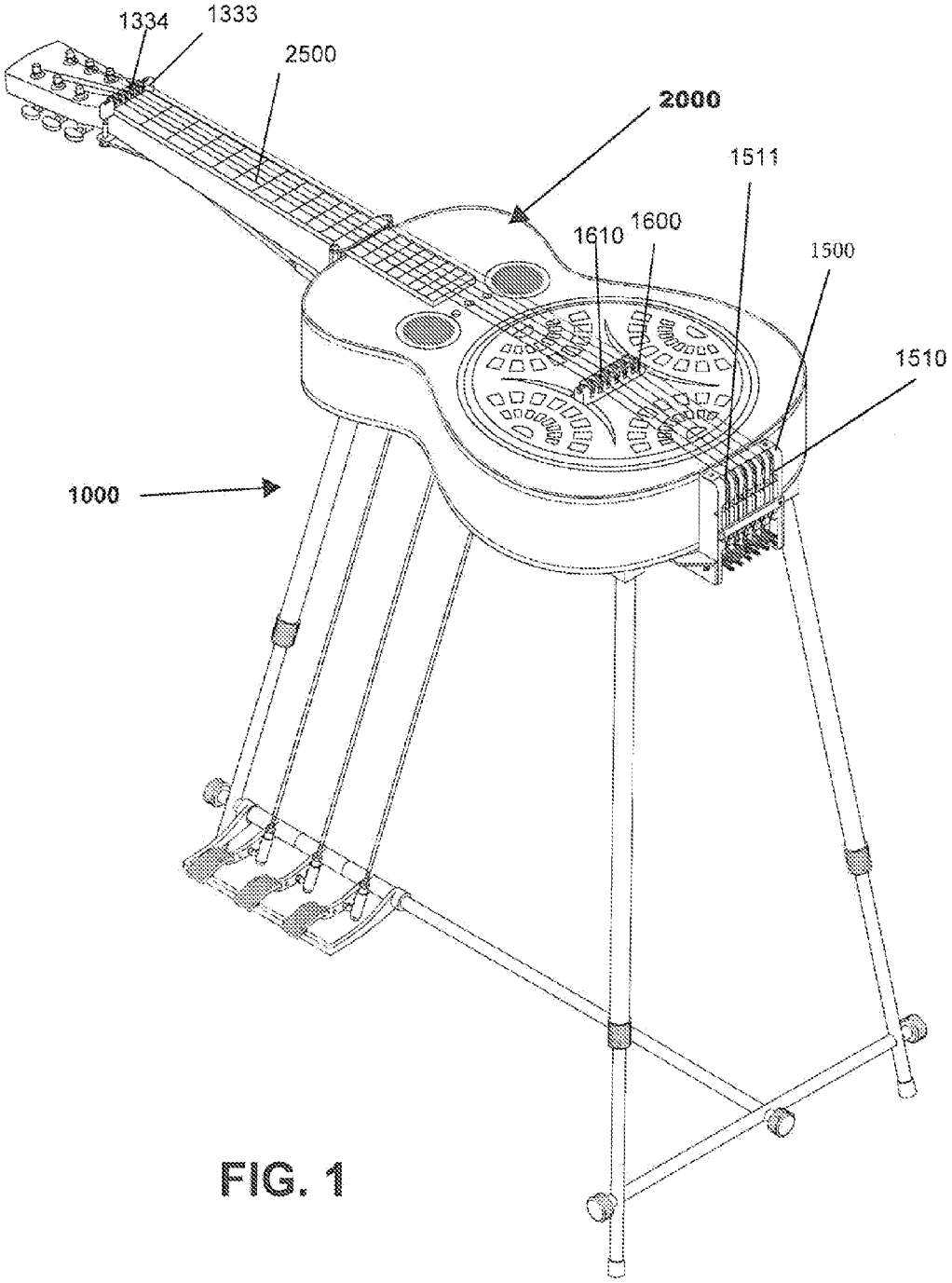
FIG. 1 is a perspective view of a stringed musical instrument securely placed to a transformable stand with a foot operated string pitch changing mechanism.
Figure 2:
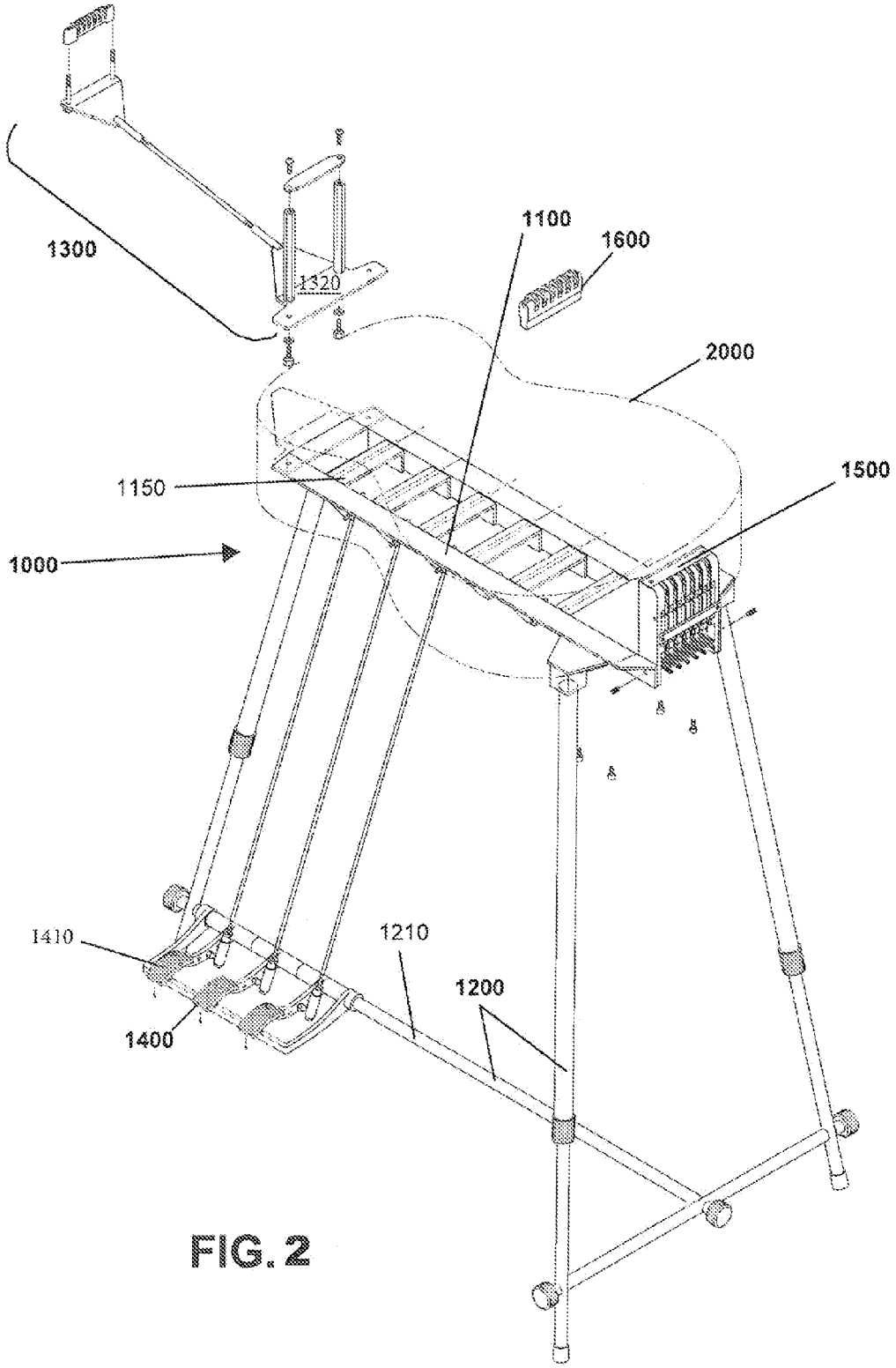
FIG. 2 is a partially exploded perspective view of the transformable stand of FIG. 1.

FIG. 1 is a perspective view of a musical instrument 2000 (e.g., a Resonating or "Dobro" guitar) coupled to a pitch-changing apparatus 1000. FIG. 2 is a partially exploded perspective view of the pitch-changing apparatus 1000 with the musical instrument 2000 drawn in see-through broken lines to illustrate the structure of the apparatus 1000. As shown in the figures, the apparatus 1000 comprises six subassemblies or components: (1) the base frame 1100; (2) the leg assembly 1200; (3) the truss rod assembly 1300; (4) the pedal assembly 1400; (5) the string pitch changer housing 1500; and (6) the bridge housing 1600.

The Base Frame 1100

As shown in FIG. 2, the base frame 1100 is the central component of the apparatus 1000. In the preferred embodiment, the base frame 1100 is positioned atop of the leg assembly 1200 and may optionally support the truss rod assembly 1300 at one end and the string pitch changer housing 1500 on the other end. As discussed in greater detail below, the base frame 1100 is configured to transfer the mechanical movement of the foot pedal assembly 1400 to the string pitch changer housing 1500 so that the tautness of the strings of an instrument 2000 may be manipulated.

Figure 3:
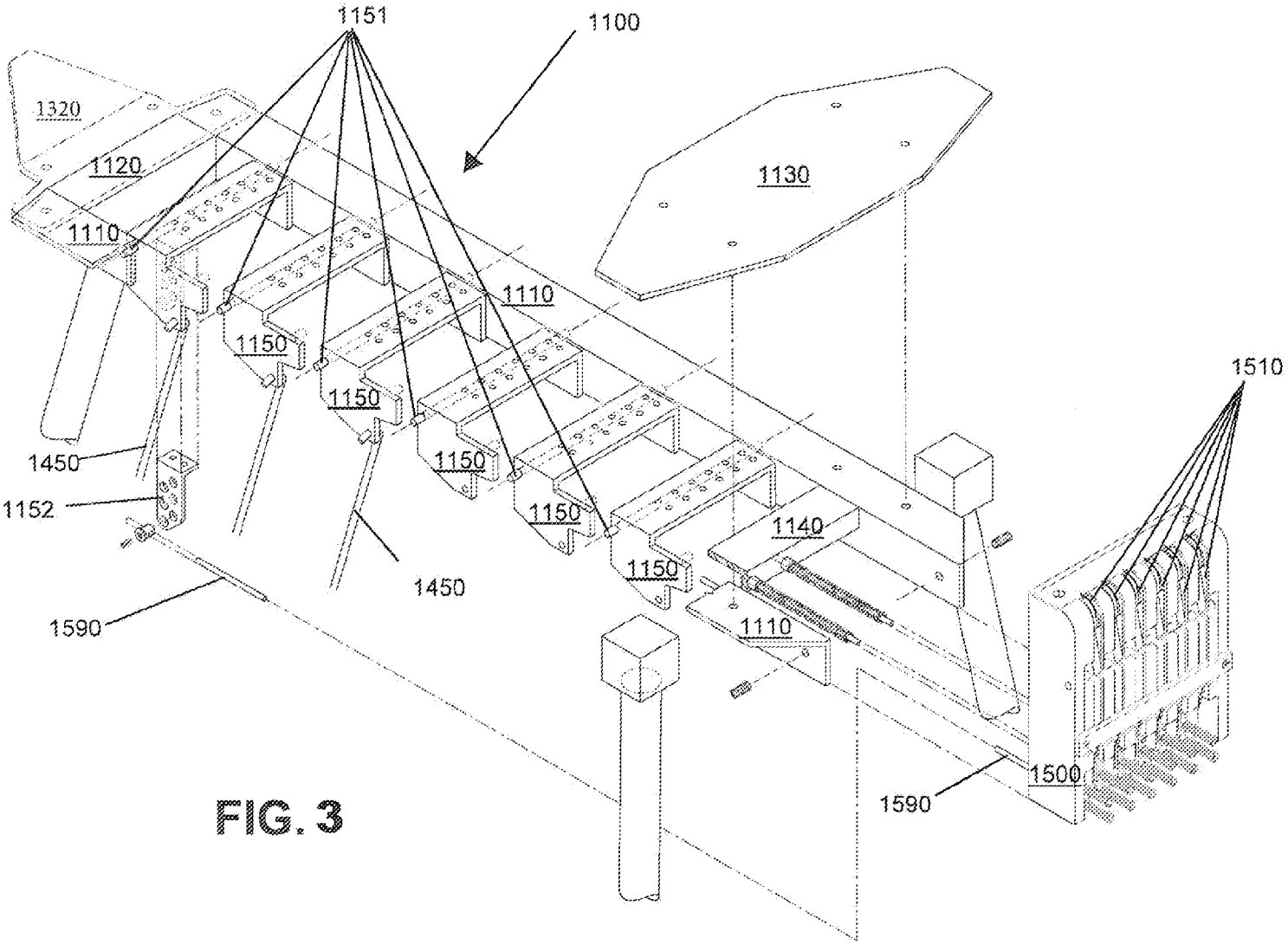
FIG. 3 is a perspective and partial exploded view of a frame of the stand of FIG. 1.

FIG. 3 is an exploded view of the base frame 1100. As illustrated, the base frame 1100 is defined by: two parallel beams 1110; an end piece 1120 for coupling one end of the two parallel beams 1110; a support plate 1130, and a cross bar 1140 that spans between the two parallel beams 1110 (one is depicted in a cut-away). Structurally, the two parallel beams 1110, the end piece 1120, and the cross bar form a rectangle. The support plate 1300 is preferably positioned over the cross bar 1140 as shown in FIG. 2. Referring to FIGS. 2 and 3 the frame 1100 may be coupled to the truss rod assembly 1300 (the connecting component of the truss rod assembly 1300 is shown in FIG. 3 in broken lines). Referring back to FIG. 3, one end of the base frame 1100 is configured to receive the string pitch changer housing 1500 in an upright position between the beams 1110 and adjacent to the cross bar 1140 in the manner shown. Suitably, the base frame 1100 features a plurality of bell cranks 1150 that are pivotally mounted between the beams 1110. The bell cranks 1150 are configured to pivot around an axis 1151. Each bell crank 1150 features a rod puller 1152 that may be positioned at any location on the crank 1150 between the beams 1110. Alternatively, multiple rod pullers 1152 could be provided on a crank between the beams. Suitably the rod pullers 1152 are configured to align with the pitch changers 1510 of the pitch changer housing 1500. In operation, the bell crank 1150 transfers the mechanical movement of a foot pedal rod 1450 to corresponding string pitch changer rod 1590. The frame 1100 is configured to be supported by the leg assembly 1200.

The Leg Assembly 1200

FIG. 2 illustrates the leg assembly 1200. The leg assembly is defined by a T base 1210 and three telescoping legs 1220. The height of the telescoping legs may be adjusted to accommodate users of differing height or use in standing or sitting positions. Preferably, two of the three legs interact with the support plate 1130 of the base frame 1100 while the other leg interacts with the end piece 1120 to support the frame 1100. In a preferred embodiment, the T frame 1210 is configured to pivotally support, the foot pedal assembly 1400. In other embodiments, four or more legs might be used for the leg assembly 1300.

Figure 2A:
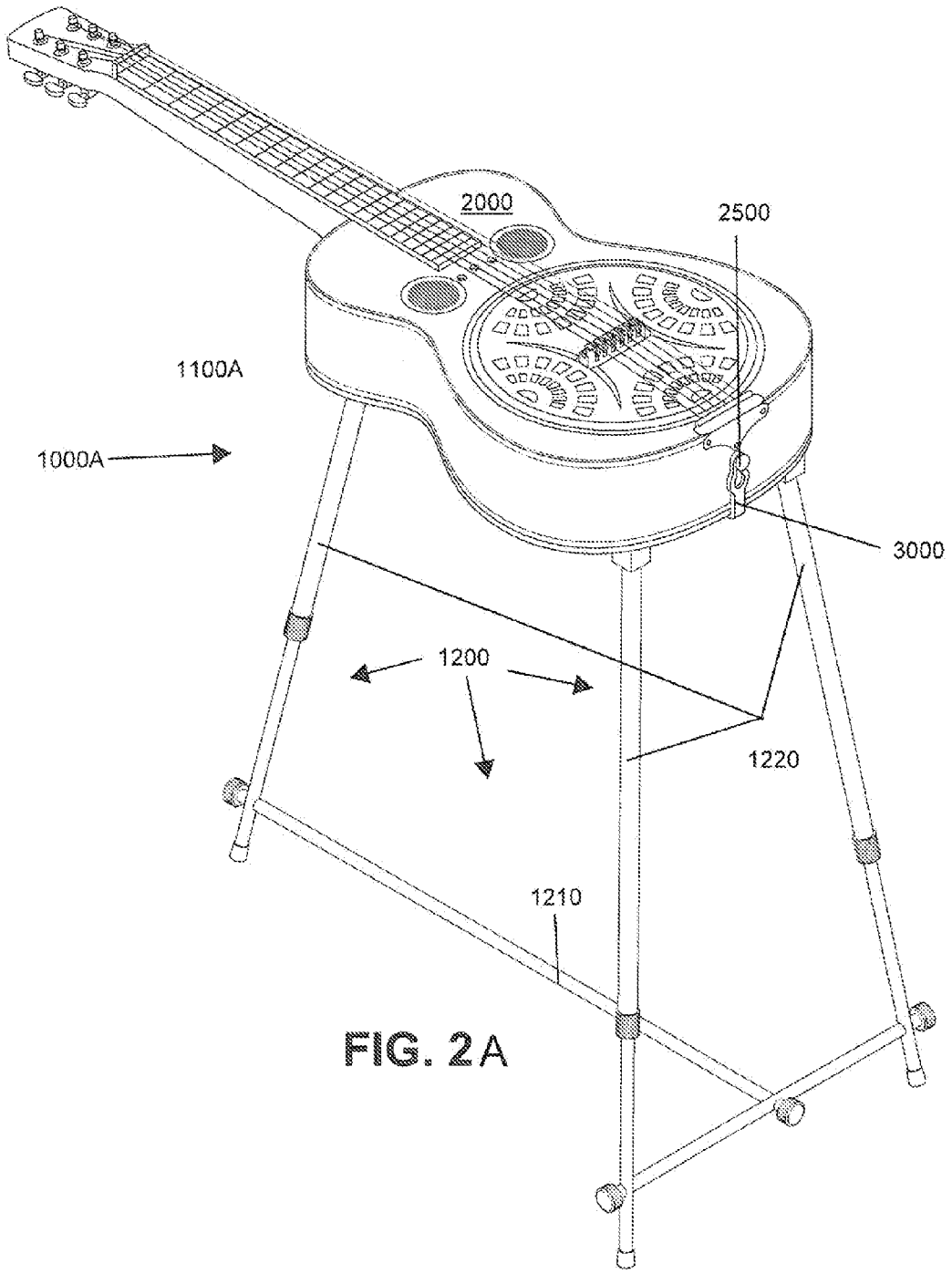
FIG. 2A is a perspective view of an alternate embodiment of the stand.
Figures 2B, 2C:
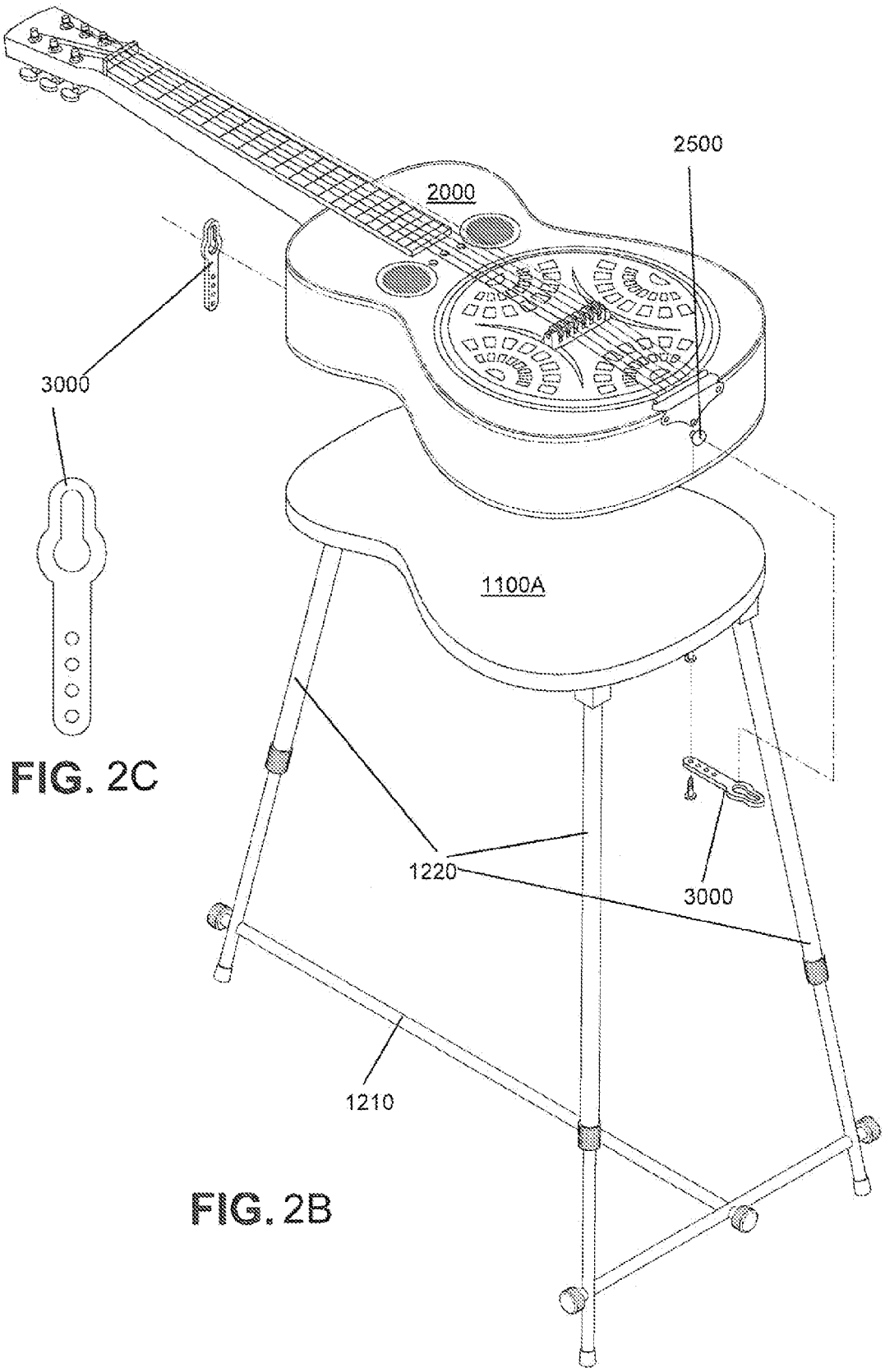
FIG. 2B is an exploded perspective view of the stand of FIG. 2A.
FIG. 2C is a zoom-in view of a strap.

FIG. 2A shows another embodiment of a guitar stand without pitch changing capabilities. FIG. 2B shows an exploded view of the guitar stand 1000A. As shown in FIG. 2A, the leg assembly 1200 may be used to create a guitar stand 1000A for a guitar 2000. In this embodiment (FIGS. 2A and 2B), the leg assembly 1200 is positioned underneath a support surface 1100A that supports the guitar 2000. In a preferred embodiment of the guitar stand 1000A, the guitar 2000 may be secured to the support surface 1100A via two straps 3000 (or draw clamps) secured to the underside of the support surface and a nub 2500 at the bottom of the instrument 2000 and at the top of the instrument at the intersection of the guitar 2000 neck and body and illustrates the strap 3000. FIG. 2C shows the strap, which has a plurality of apertures for adjusting the length of the strap relative to the guitar 2000 to be supported on the stand 1000A.

The Truss Rod Assembly 1300 and the Bridge Housing 1600

Figures 4, 5:
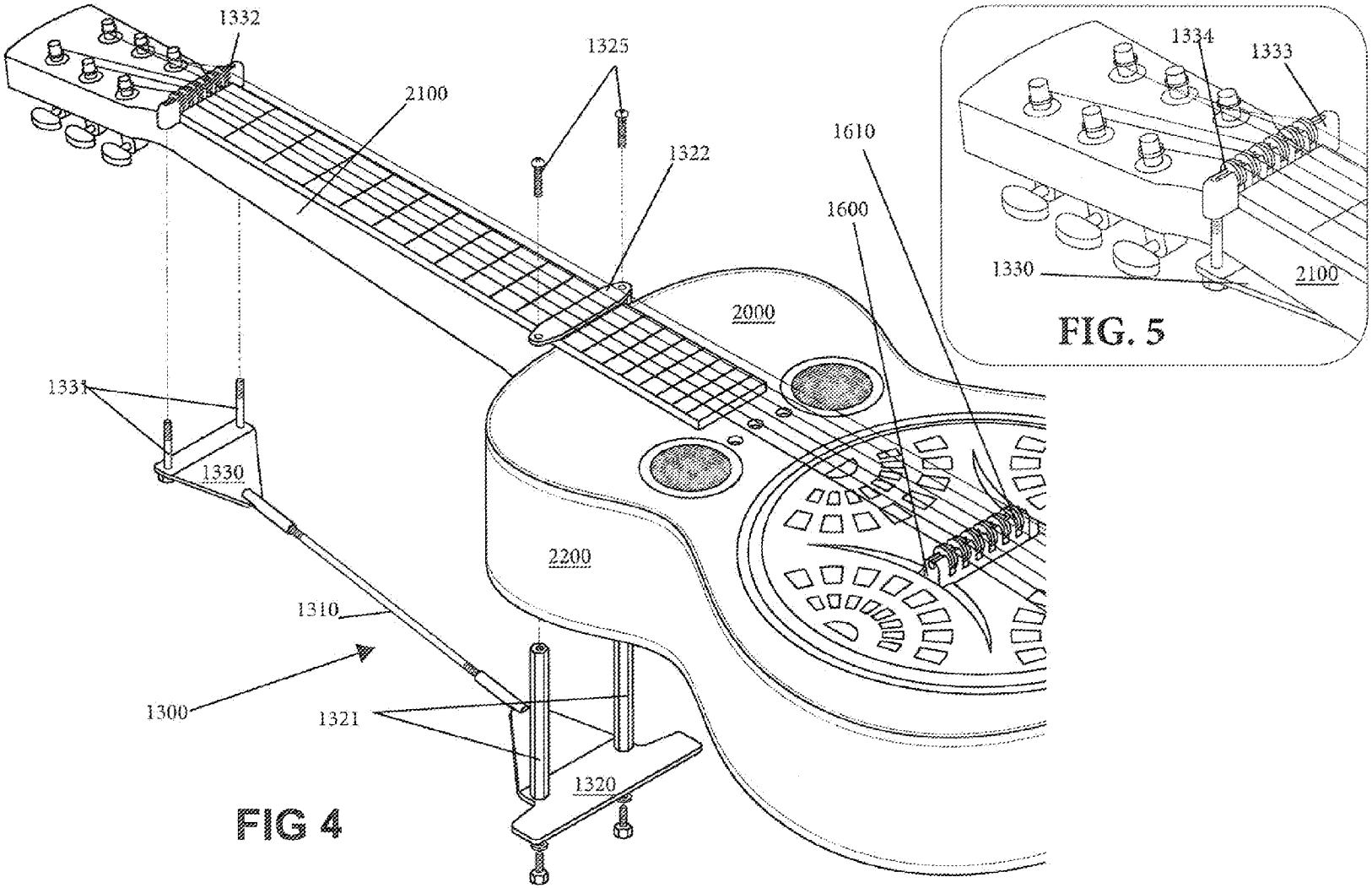
FIG. 4 is a perspective view of a musical instrument.
FIG. 5 is a zoom in view of a keyhead of a musical instrument.

FIG. 4 shows an exploded view of the truss rod assembly 1300 and an installed bridge housing 1600. As shown, the truss rod assembly 1300 is defined by the truss rod 1310, a neck plate 1320, and a roller nut plate 1330 plus roller nut 1331. As shown in FIGS. 2, 3 and 4, the neck clamp is configured to be coupled to the frame 1110 over the end piece 1120.

FIGS. 4 and 5 depict the appropriate placement and assembly of the truss rod 1300 so that the neck 2100 of the stringed musical instrument 2000 is supported on the transformable stand 1000 (not shown). FIG. 4 depicts an exploded truss rod 1300 in position for installation on a stringed instrument 2000. FIG. 5 depicts a fully assembled truss rod 1300 onto a stringed musical instrument 2000. In one embodiment, a truss rod 1310 is placed at the bottom of the neck 2100 of the stringed musical instrument 2000 to help support and reduce stress that may placed upon the neck 2100 during the playing of the stringed musical instrument 2000 affixed to the apparatus 1000 (see FIG. 1).

In the depicted embodiment shown in FIGS. 2, 4, and 5, a truss rod assembly 1300 contains a roller nut plate 1330 and a neck plate 1320 on both ends of the truss rod 1310 to attach to both ends of the neck 2100 of the stringed musical instrument 2000 onto the apparatus (see FIGS. 1 and 2). The ends of the rod may be threaded so that the length of the rod may be effectively lengthen or shortened to accommodate instruments with variously dimensioned necks 2100. Referring to FIGS. 2 and 4, the neck plate 1320 can be attached to the frame 1100 so that the guitar 2000 may be fully supported and secured onto the apparatus 1000. Furthermore, in another embodiment, a bridge housing 1600 with brass rollers 1610 replaces the existing bridge on the stringed musical instrument.

FIGS. 4 and 5 illustrate the installation of the truss rod assembly 1300. In the embodiments shown in FIGS. 4 and 5, the roller nut plate 1330 has two roller nut clamp screws 1331 that span the width of neck of the stringed musical instrument. Preferably, the roller nut plate 1330 is placed beneath the keyhead of the neck 2100 of the stringed musical instrument 2000. Correspondingly, a roller nut assembly 1332, which consists of roller nut housing 1333 (FIG. 5) and brass and gauged rollers 1334 (FIG. 5), is placed over the neck 2100 and coupled to the roller nut plate 1330 via roller nut screws 1331. In the preferred embodiment, the screws 1331 are tightened so that the roller nut assembly 1332 may be securely placed over the neck 2100 of the stringed instrument 2000.

Still referring to FIGS. 4 and 5 for installation of the truss rod assembly 1300, a neck plate 1320 on the truss rod 1310 has two clamp screw posts 1321 that span the width of the neck 2100 of the stringed musical instrument 2000. The neck plate 1320 is placed beneath the neck 2100 of the stringed instrument 2000 where the neck 2100 of the stringed musical instrument 2000 connects to the body 2200. Continuing with installation, a neck clamp plate 1322 with two screw holes located at opposite ends are placed over the neck 2100 and positioned to align with the clamp screw post 1321, allowing the screws 1325 to be placed through the neck clamp plate 1320 and the clamp screw post 1321 so that the neck 2100 may be firmly secured onto the base frame (see FIGS. 1 and 2).

Figures 4A, 5A:
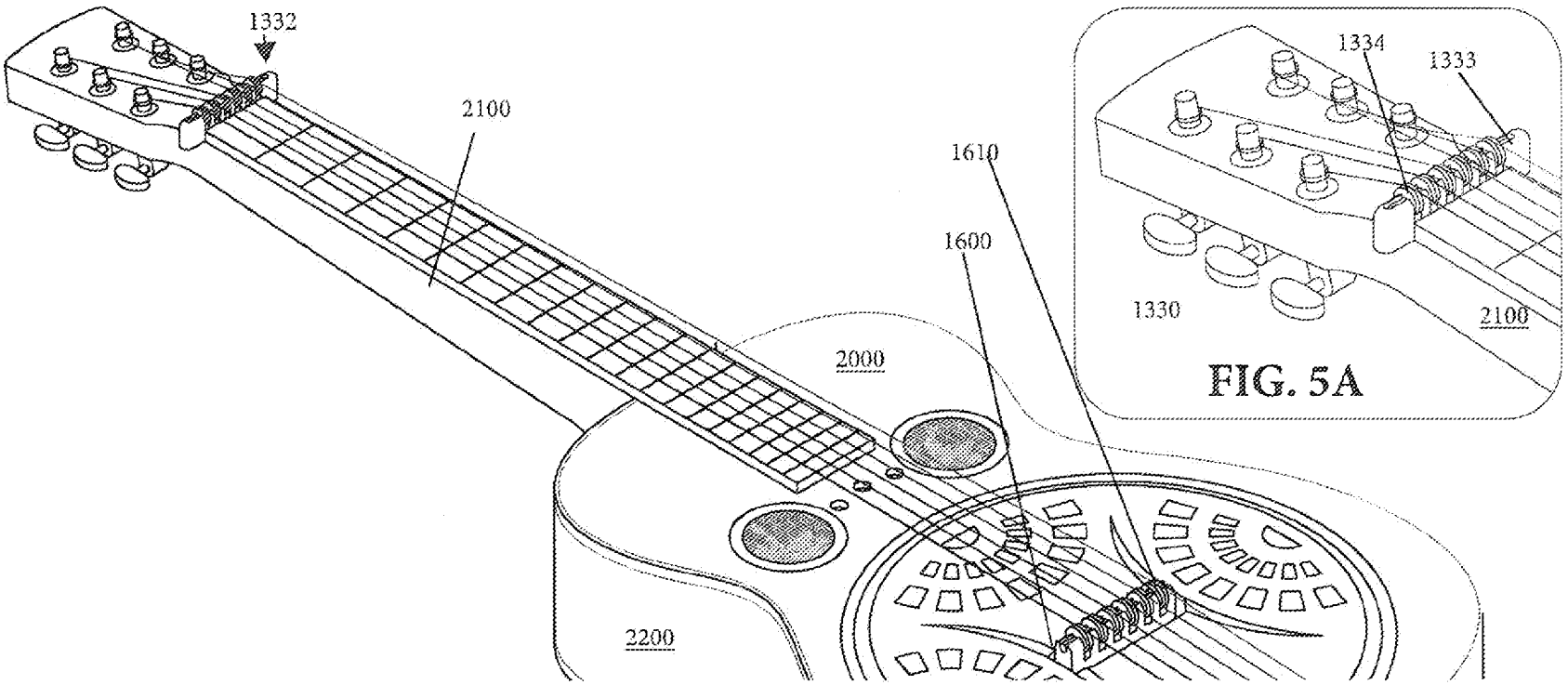
FIG. 4A is a perspective view of a musical instrument.
FIG. 5A is a zoom-in view of a keyhead of a musical instrument.

It should be noted that the truss rod assembly 1300 is an optional feature of the apparatus 1000. FIGS. 4A and 5A respectively illustrate installation of the roller nut 1332 without a truss rod assembly (1300 FIGS. 4 and 5). In this embodiment, the roller nut 1332 replaces the nut of the guitar that is adjacent to the keyhead of the guitar 2000. Suitably, the roller nut assembly 1332 will fit into the groove that results from removal of said nut, as shown.

Pedal Assembly 1400

Figure 6:
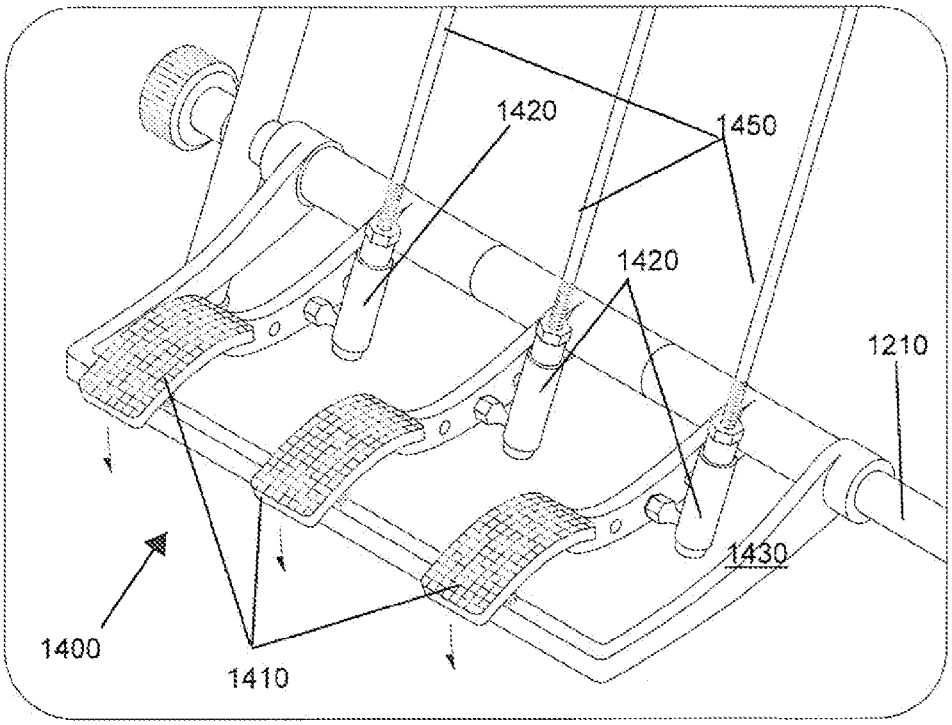
FIG. 6 is a zoom-in perspective view of a pedal assembly.

FIG. 2 shows the foot pedal assembly 1400. FIG. 6 shows a zoom-in view of the foot pedal assembly 1400 depicted in FIG. 2. Referring to FIG. 6, the foot pedal assembly 1400 is defined by foot pedals 1410, quick-connect ball joints 1420, foot pedal rods 1450, and floor stop 1430. The foot pedal 1410 is suitably pivotally mounted to the T frame 1210 of the leg 1200 assembly (see FIG. 2). In operation, pressing down on the foot pedal 1410 pulls the attached pedal rod 1450 which is connected to a bell crank 1150 on the frame 1100 of the transforming stand 1000. As discussed above, the crank 1150 in the housing frame 1100 translates the motion of the foot pedal rod 1450 to the string pitch changer 1290 (this will be discussed in greater detail below) (see FIG. 3).

Referring still to FIG. 6, In a preferred embodiment, the pedal rod 1450 features a turnbuckle (not shown) for lengthening or shortening the rod 1450 whereby the pitch change of an instrument may be calibrated to the depth of pedal 1410 depression. Suitably, other full stops (e.g., a floor stop for instance) is be incorporated and similarly calibrated so that pedal depression does not result in cabinet drop (or bending of the instrument 2000 body under the torque caused by pedal depression).

The String Pitch Changer Housing Assembly 1500

Figure 7:
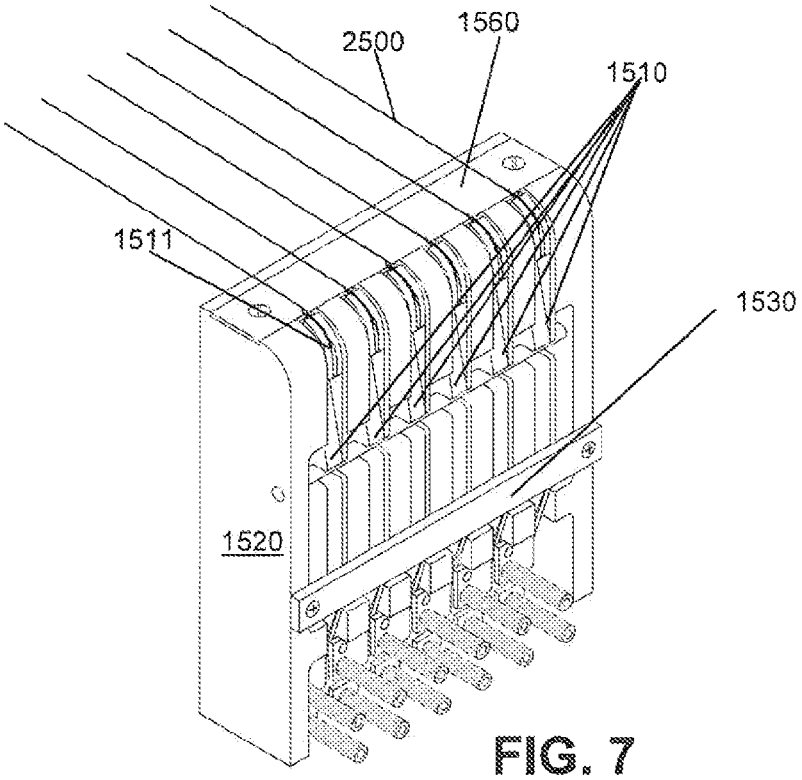
FIG. 7 is a perspective view of a pitch changer housing.

FIG. 7 is a perspective view of a string pitch changer housing assembly 1500. The housing assembly 1500 is also depicted in place on the apparatus 1000 in FIGS. 1, 2, and 3. As shown in FIG. 7, the assembly 1500 is defined by a plurality of pitch changers 1510 (usually one per string of the instrument 2000 (FIG. 1)) within a housing 1520 with a stop bar 1530 and a pivot plate 1560. The top of the pitch changer 1510, which is suitably designed to raise the tension of a string 1510 when activated, incorporates a string catch 1511, for coupling the pitch changer 1510 to a string 2500 of a musical instrument (not shown in FIG. 7). FIG. 1 illustrates an installed housing assembly 1500. As shown, strings 2500 are secured to the key head of an instrument 2000, passed over the gauged brass rollers 1334 of the roller nut housing 1333 and rollers 1610 of the bridge housing 1600 before being mechanically coupled to the pitch changer 1510 via the string catch 1511. As discussed later below, the connection of the strings to the pitch changer 1510 allows the foot pedal assembly 1200 (FIG. 2) to tighten or loosen the strings to produce varied pitch sounds. In other words, the Pitch changer housing assembly 1510 is an integral tuning member that converts existing stringed musical instruments, like fixed-pitch, standard, resonating or "Dobro" guitars, to stringed instruments with pitch changing capabilities operated by the foot pedal assembly 1200 (FIG. 2). In a preferred embodiment, the housing is coupled to the guitar via a screw into the bottom of the guitar house and at the top of the body where the neck and guitar meet.

Figure 8A:
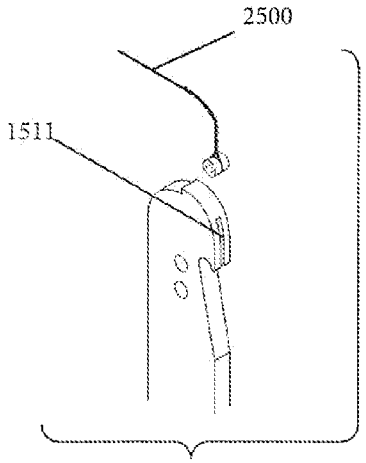
FIG. 8A is an environmental view of a pitch changer.
Figure 8:
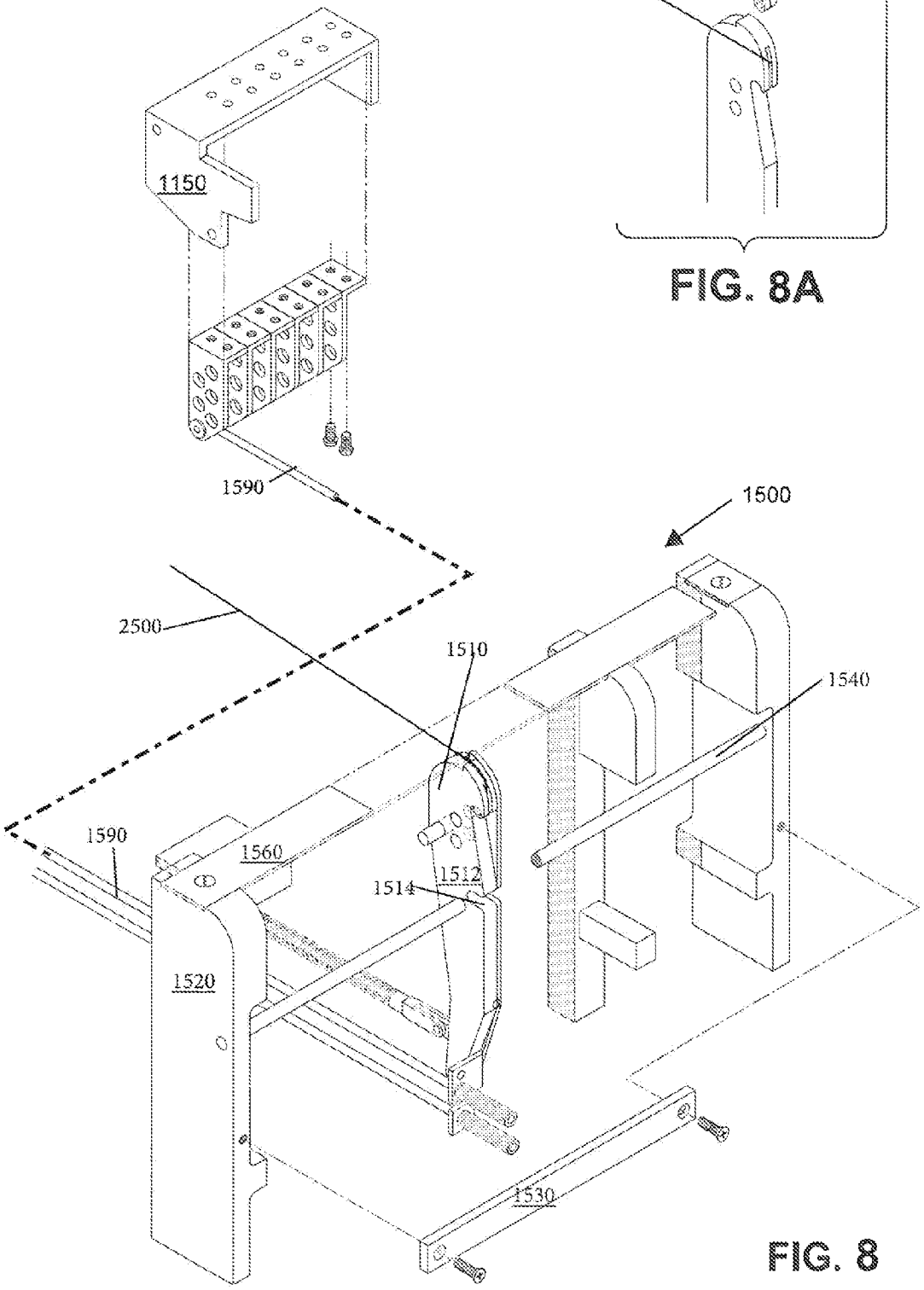
FIG. 8 is an exploded view of the pitch changer housing.
Figure 8B:
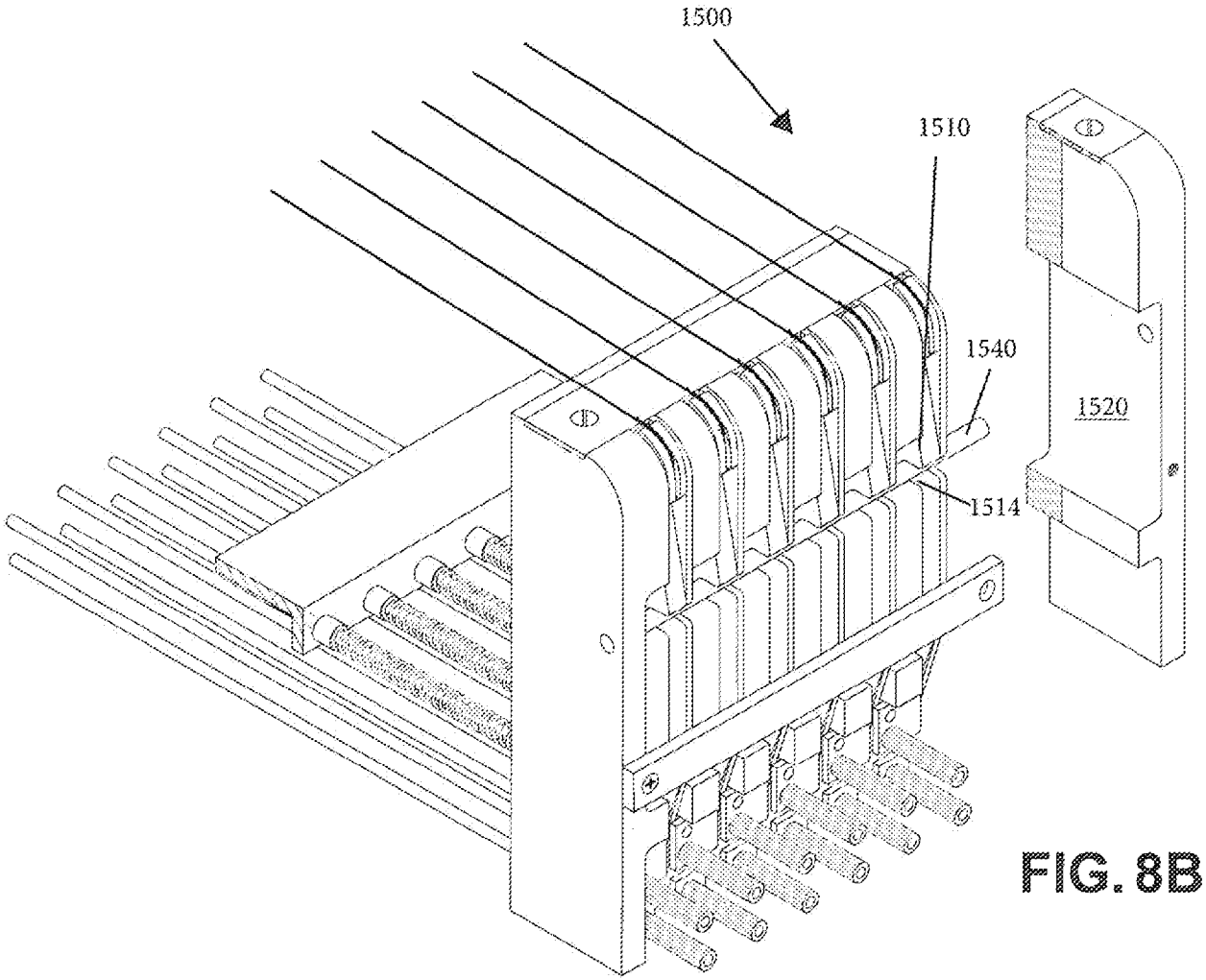
FIG. 8B is another exploded view of the pitch changer housing.
Figure 9:
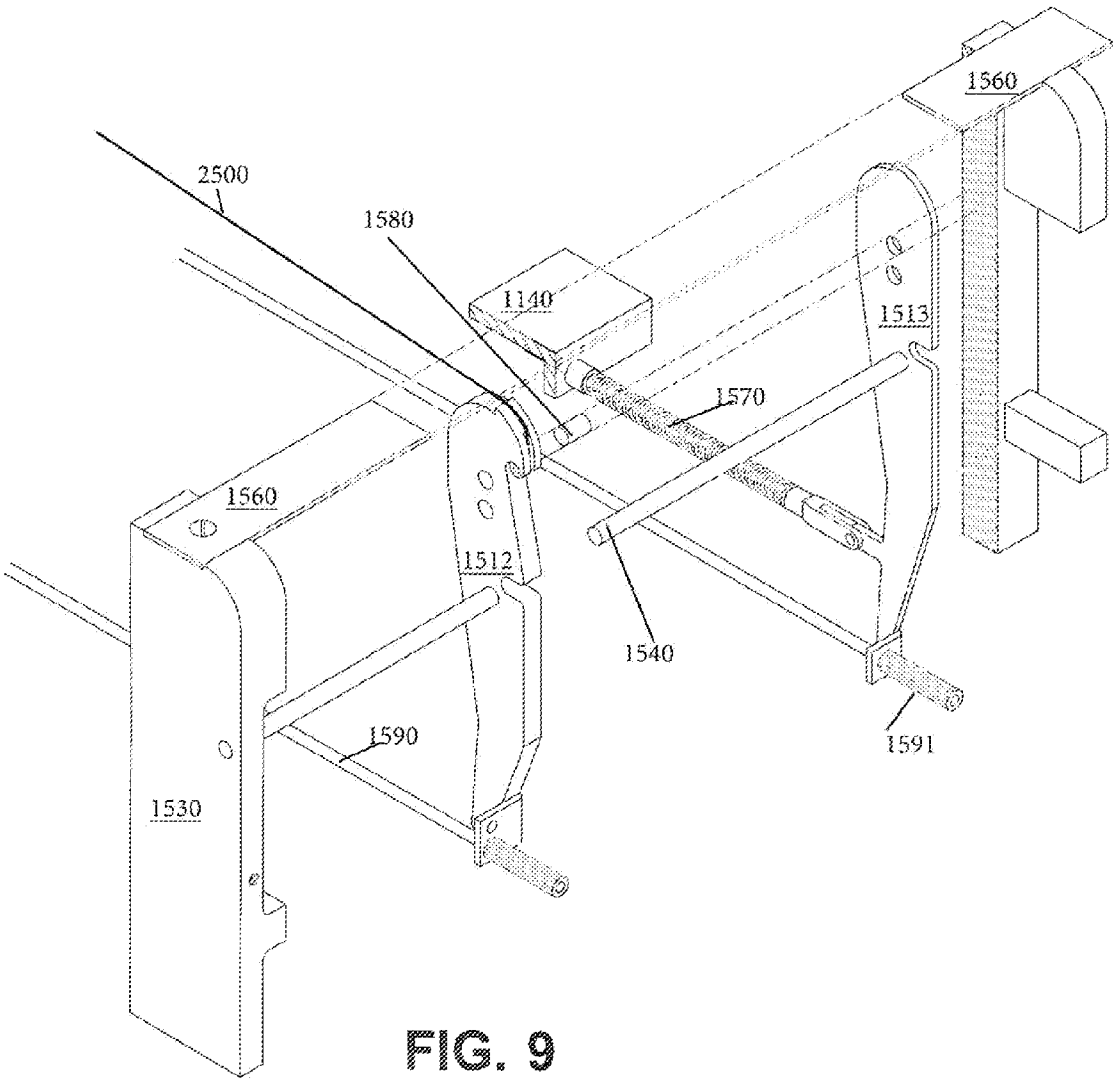
FIG. 9 is another exploded view of the pitch changer housing.

FIG. 8 is a partially exploded view of a preferred embodiment of a string pitch changer housing 1500 with a single pitch changer 1510 depicted. FIG. 9 is a full exploded view of the first embodiment of a string pitch changer housing assembly 1500 with the pitch changer 1510 exploded. As shown in these figures in the context of FIG. 1, the strings 2500 are suitably each placed into each individual string pitch changer 1510. FIG. 8A illustrates the coupling of a string 2500 with the string catcher 1511 of the pitch changer 1510. As shown in FIGS. 8 and 9, each individual string pitch changer 1510 can be removed or replaced from the string pitch changer housing 1500 without disturbing other pitch changers 1510. Suitably, the pitch changers 1510 float within the housing 1520 and are retained therein by a retaining rod 1540 provided through a slot 1514 in the pitch changer 1510. FIG. 8B, a partially exploded view of the housing 1500, shows the retaining bar 1540 disposed in the slot 1514 of the changers 1510. FIG. 9 shows an individual string pitch changer 1510 comprising a raise lever 1512 and a lowering lever 1513 connected by a pin 1580. Suitably, the levers 1512/1513 are pivotable around the pin 1580. Suitably the lowering lever 1513 interacts with a pivot plate 1560 disposed in pivot groove 1531 in the lower bar 1513. As shown in FIG. 8, each of the raise lever 1512 and lower lever 1513 are mechanically coupled to a pitch changer (or "pull") rod 1590 that are also mechanically coupled to a bell crank 1150. As set forth in detail below, the pivot bar 1530 interacts with the pivot groove 1531 to shift the location of the raise bar 1512 when the changer rod 1590 of the lowering lever 1513 is pulled. Each pull rod 1590 features a nylon tuning screw 1591 to adjust the effective length of the rod relative to the pitch changer 1510. Suitably, the lowering lever 1513 is mechanically coupled to a compression spring 1570 extending from the cross bar 1140 of the frame 1100 (not shown) so that the lever 1513 may also have a rest position against the stop bar 1530 of the assembly housing 1530.

Figure 10:
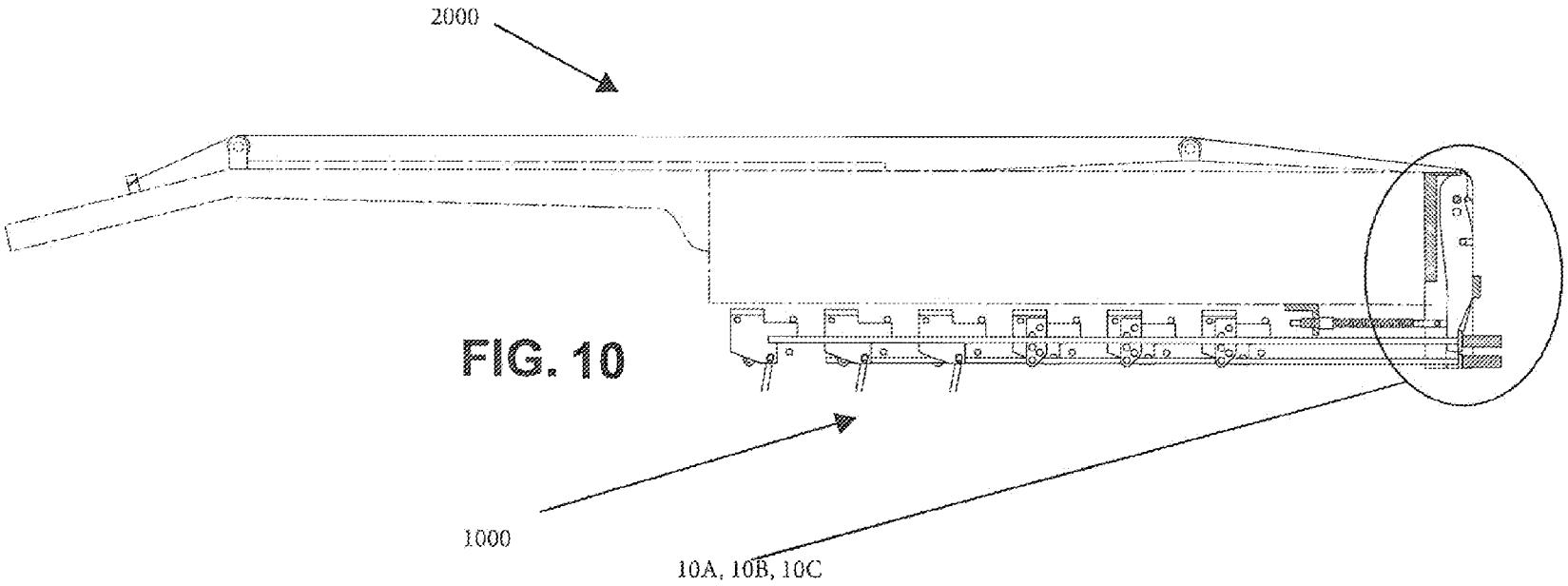
FIG. 10 is a cross section of an instrument on a stand.
Figures 10A, 10B, 10C:
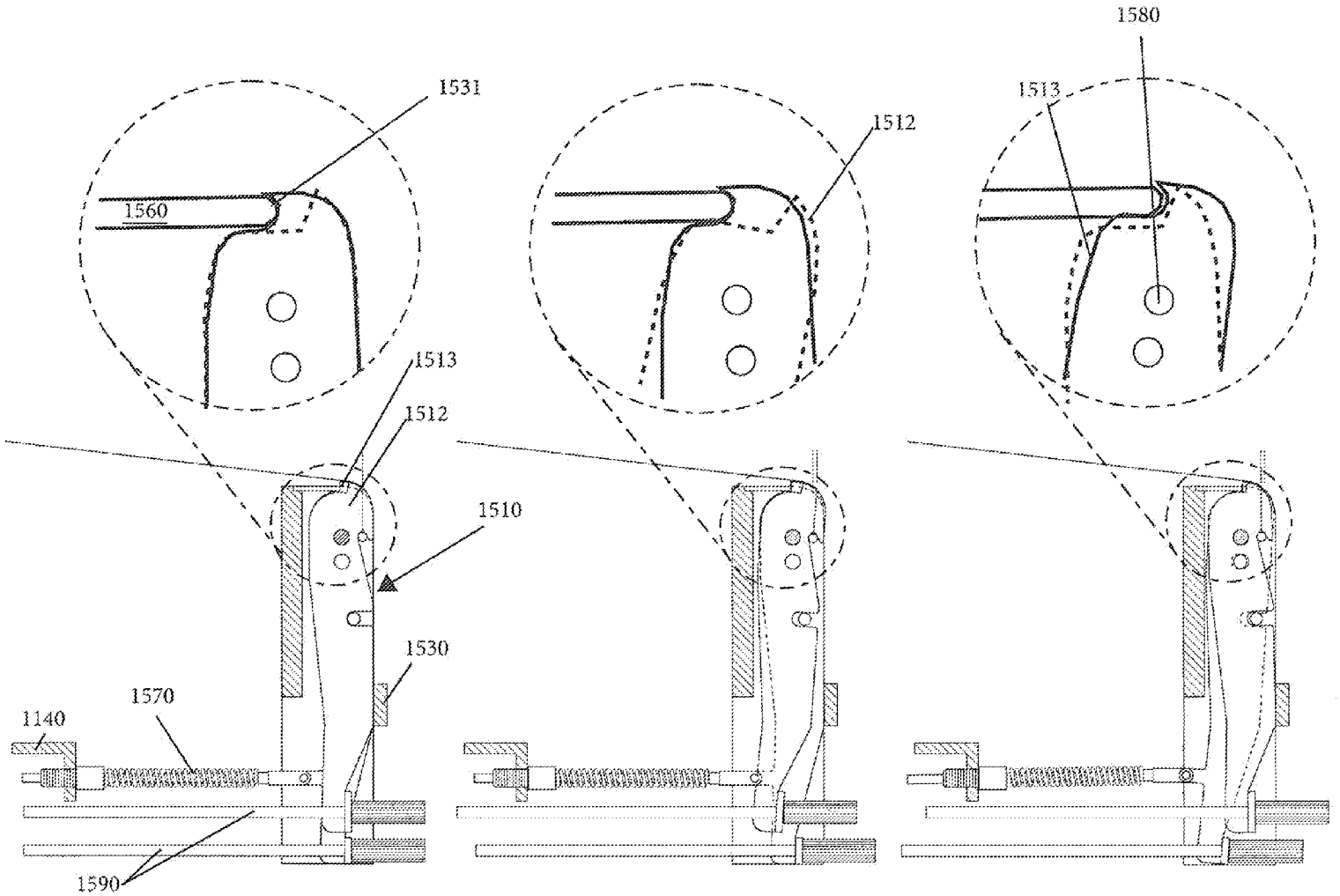
FIG. 10A is a zoom-in view of FIG. 10.
FIG. 10B is an alternate zoom-in view of FIG. 10.
FIG. 10C is an alternate zoom in view of FIG. 10.
Figure 11:
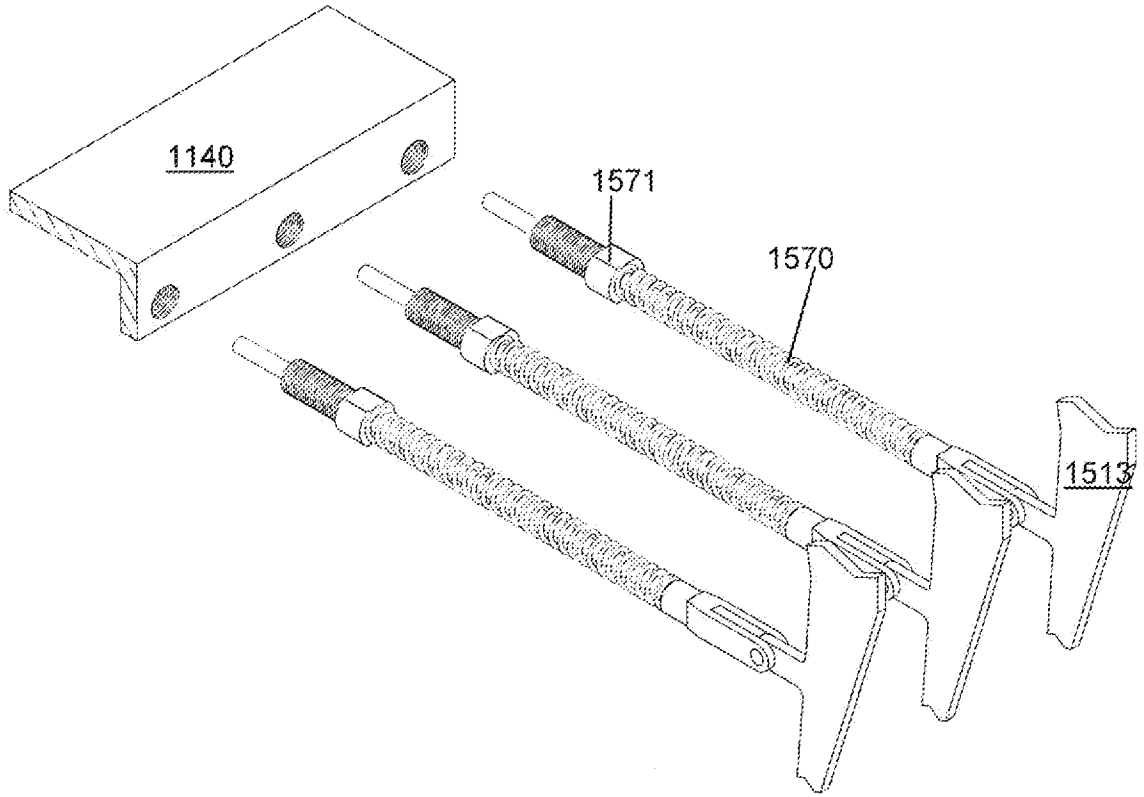
FIG. 11 is a perspective view of a compression spring.
Figure 12:
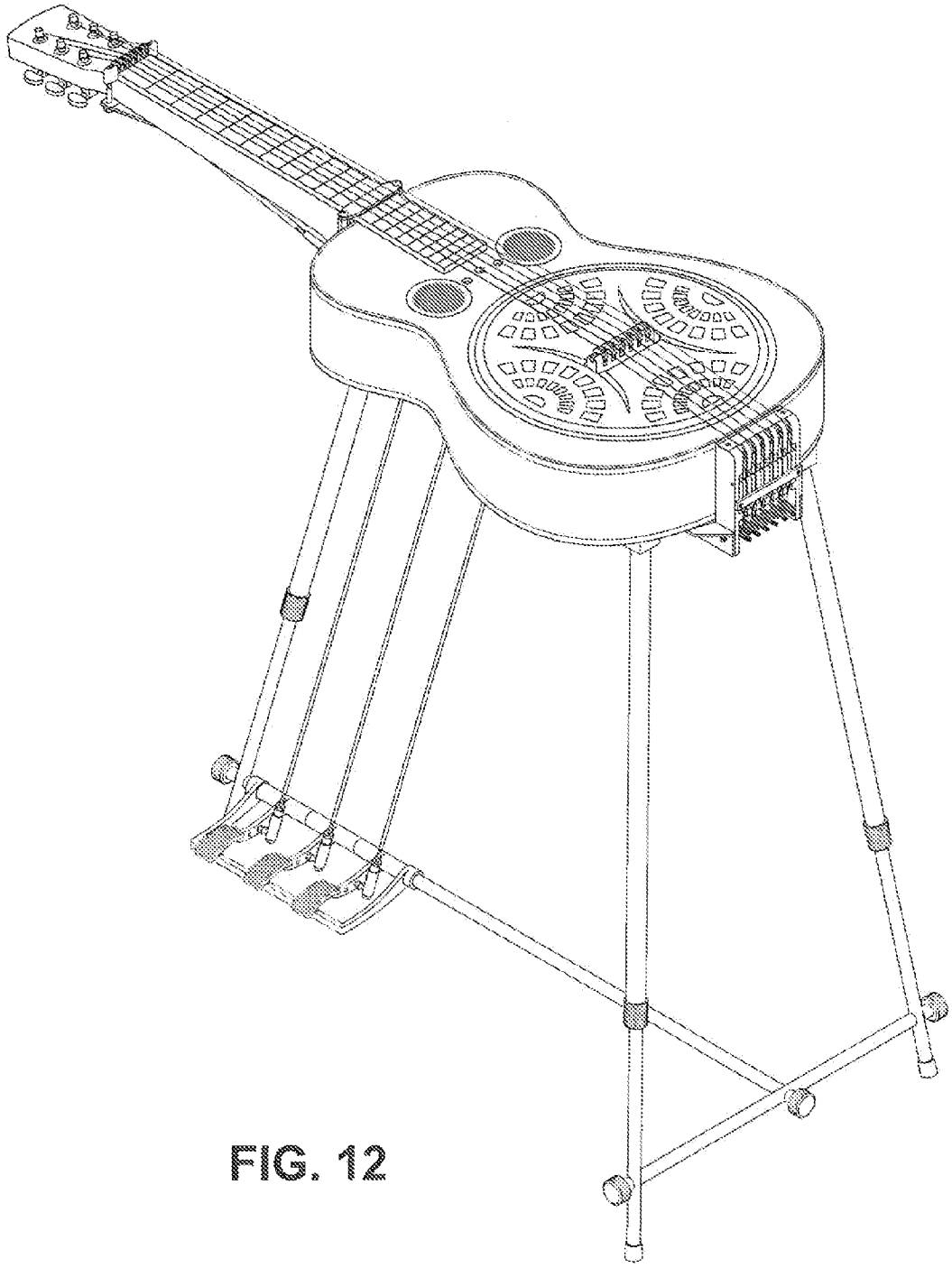
FIG. 12 is a perspective view of an instrument on a stand.

FIG. 10 depicts a cross section of a musical instrument installed in the apparatus 1000. FIGS. 10A through 100 respectively depict operation of the string pitch changer 1510 within the string pitch changer housing 1500 at the circled portion of FIG. 10. Specifically, FIG. 10A illustrates a neutral pitch changer 1510, FIG. 10B illustrates a pitch changer 1510 with the raiser lever 1512 being pulled by its rod 1590, and FIG. 100 illustrates a pitch changer 1510 with the lowering lever 1513 being pulled. Referring first to FIG. 10A, the string pitch changer 1510 is normally positioned with the lowering lever 1513 forced against the stop plate 1530 via the spring 1570 and the pivot plate 1560 positioned within the pivot grove 1531. As shown, the pivot plate 1560 features a rounded or curved edge that cooperates with the pivot groove 1531. In FIG. 10B, the rod 1590 pulls the raiser lever 1512 to pivot around the pivot pin 1580. As the raiser lever 1512 moves, the pivot plate 1560 does not interact within the pivot groove 1531 so that the lowering lever 1513 does not move. When the raise bar 1512 so moved, the strings are pulled taught via the raiser lever 1512. When the raise bar 1512 is released, the tension of the string will return the raiser lever 1512 to its initial position shown in FIG. 10A. Finally, in FIG. 10C, the lowering arm 1513 is being pulled by the rod 1590. As shown in the zoom-in, the pivot plate 1560 interacts with the pivot grove 1531 so that the lowering lever 1513 rotates around the curved edge of the pivot plate 1560. This rotation moves the raise bar 1512 toward the bridge assembly 1600 (FIG. 1) to allow the string tension to relax. Referring now to FIGS. 10A and 100, after the lowering rod 1590 has been pulled and released, the compression spring is suitably configured to push the changer 1513 back to the position of FIG. 10A. Suitably, the spring strength must exceed the tension of the string so that the changer 1510 can move back to its initial position against stop bar 1530. In a preferred embodiment, the spring force is adjustable via a threaded nut 1571 that adjusts the compression of the spring whereby the compression force of the spring may be modified or changed to accommodate strings of different diameters. An image of the compression spring and the adjustment nut 1571 is shown in FIG. 11.

Figure 13:
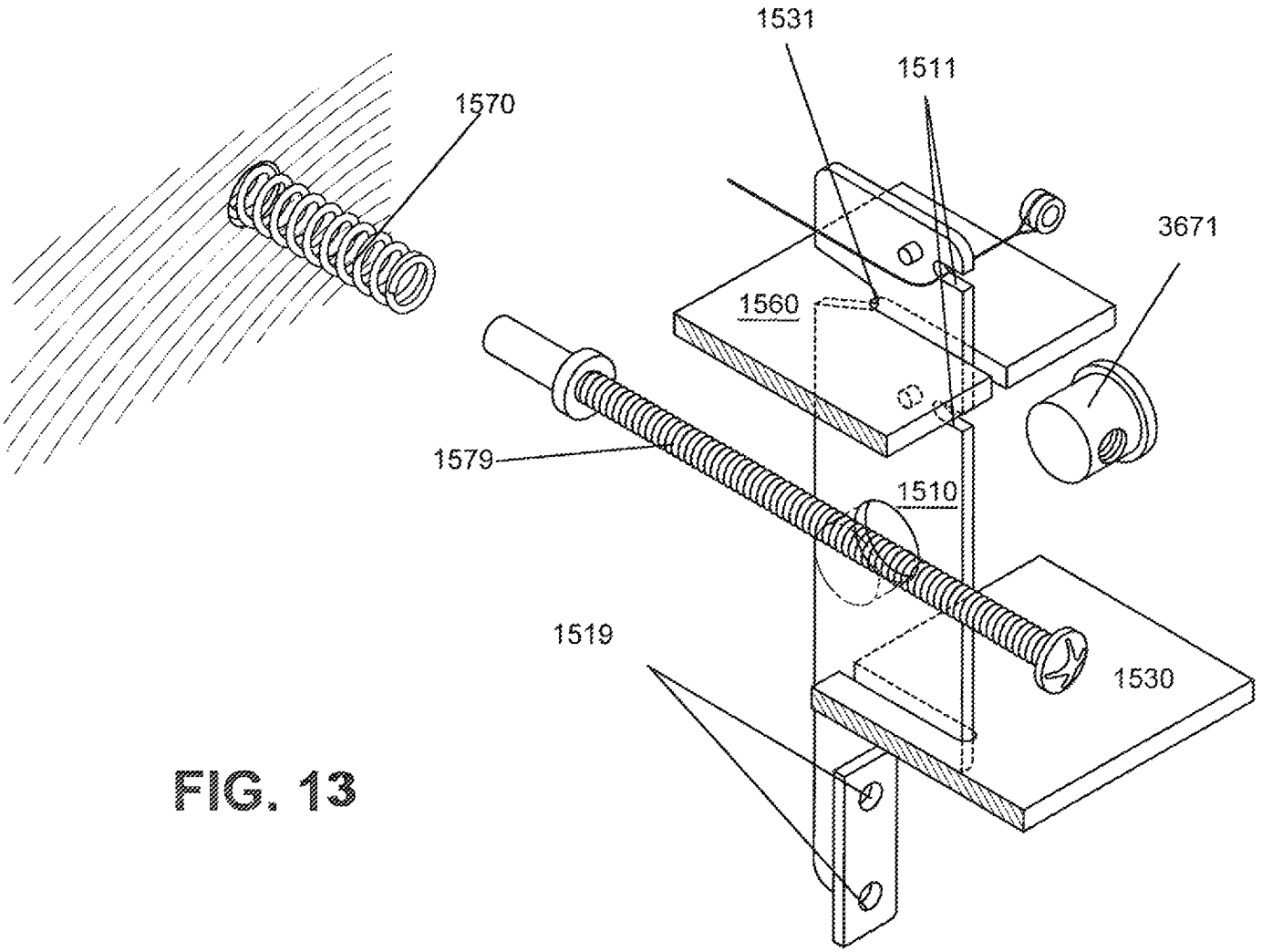
FIG. 13 is a perspective view of another embodiment of a pitch changer.
Figure 15:
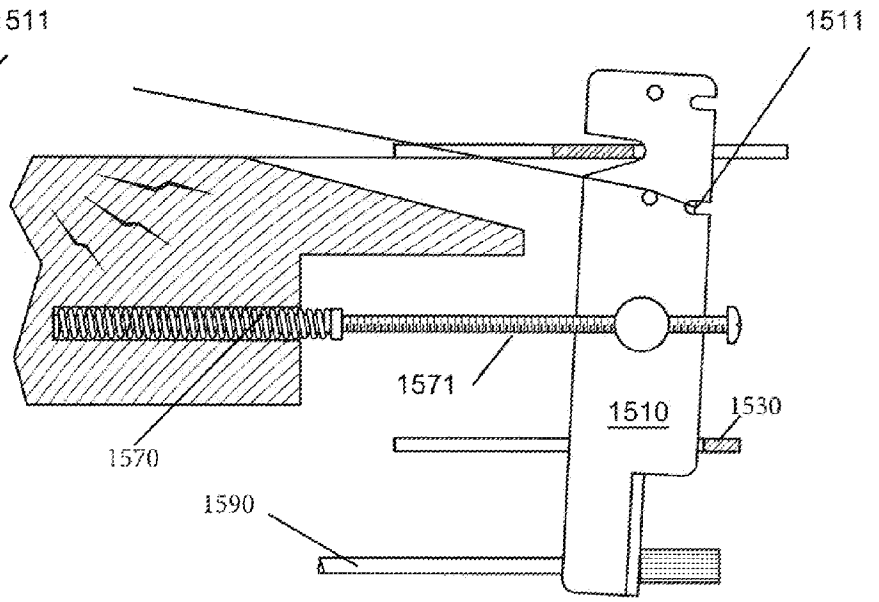
FIG. 15 is a cross section of the pitch changer of FIG. 13.
Figure 14:
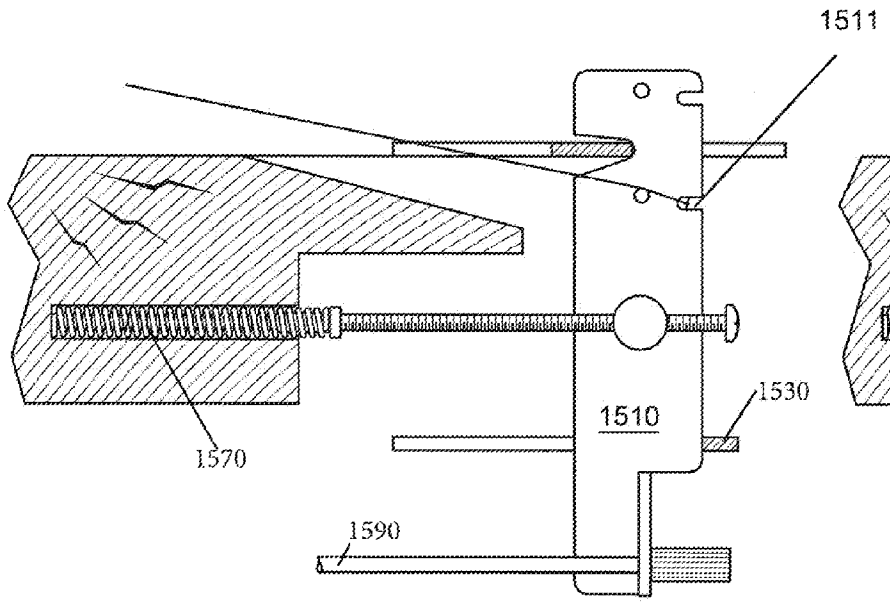
FIG. 14 is a cross section of the pitch changer of FIG. 13.
Figure 17:
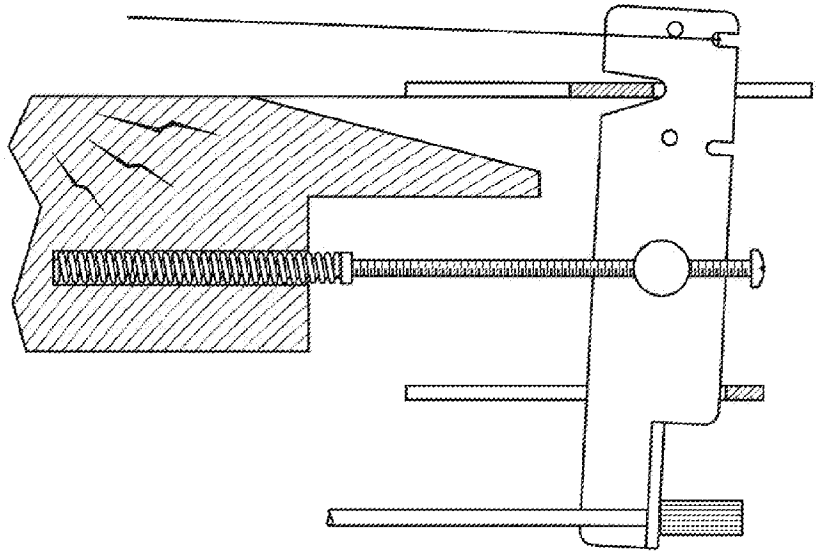
FIG. 17 is a cross section of the pitch changer of FIG. 13.
Figure 16:
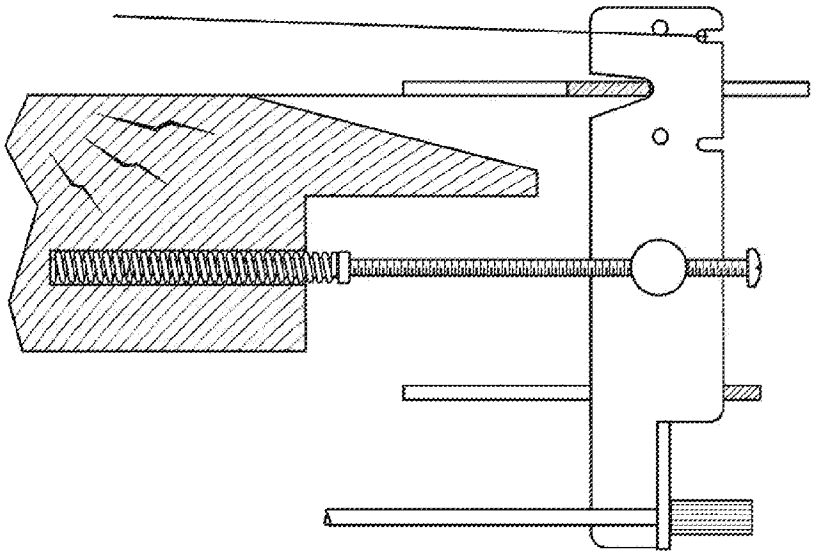
FIG. 16 is a cross section of the pitch changer of FIG. 13.

FIG. 13 shows an exploded perspective view of an alternative embodiment of a pitch changer 1510. As shown, the pitch changer housing (not shown) features a stop plate 1530, a pitch changer 1510 with a string catch 1511 and a pivot grove 1531, a compression rod 1571 and spring 1570 with a pivot 1571 for pushing the changer 1510 against the stop plate 1530, and apertures 1512 for mechanically coupling the changer 1510 to a bell crank (not shown) and foot pedal (not shown).

FIGS. 18 through 21 are cross sections of the pitch changer 1510. FIG. 18 through 21 illustrate a typical operation of the pitch changer 1510. Specifically: FIG. 18 shows a cross section of the pitch changer 1510 in a neutral position with a guitar string in a low string catch 1511; FIG. 19 shows a cross section of the pitch changer 1510 in a pulled position with the string in the lower catch 1511; FIG. 20 shows a cross section of the pitch changer 1510 in a neutral position with a guitar string in a high string catch 1511; and, FIG. 21 shows a cross section of the pitch changer 1510 in a pulled position with the string in the high catch 1511. Regardless of whether the string is positioned in the low or high catch 1511, operation is the same, but the effects are different. When the string is positioned in the low catch 1511 (FIGS. 18 and 19), pulling the pitch changer 1510 results in reduced tension of the spring. The compression spring 3670 pushes the changer 1510 back against the stop plate 1530 when the pull is released. Conversely, pulling the pitch changer 1510 when the string is in the high catch 1511 (FIGS. 20 and 21) increase the tension of the string. The tension of the string will pull the changer 1510 back to the stop plate 1530 upon release of the tension.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Additionally, the various embodiments set forth herein are described in terms of exemplary illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

I claim:

1. A device for mounting an existing fixed-pitch musical instrument that provides the capability of selectively changing a string pitch of such instrument by utilizing foot pedals comprising:

a frame that is configured to support the musical instrument, said frame featuring at least two bell cranks;

a leg assembly defined by at least one adjustable leg;

a pedal assembly with at least two pedals that are each mechanically coupled to a bell crank of the frame;

a pivot plate;

a pitch changer disposed within an assembly housing and coupled to a string of the instrument, said pitch changer with (a) a lowering lever with a pivot groove and (b) a raise lever, wherein said lowering lever and raise lever are pivotally coupled via a pivot pin, wherein said raise lever is mechanically coupled to one of the bell cranks so that depressing one of the pedals causes the raise lever to pivot around the pivot pin, and wherein said lowering lever is mechanically coupled to the other bell crank so that depressing the other pedal causes the lowering lever to pivot around one end of the pivot plate in the pivot groove; and, wherein the lowering lever is coupled to a compression spring so that the compression spring compresses when the lowering lever is pivoted around said end of the pivot plate to lower a pitch of a string.

2. The device of claim 1, wherein the pitch changer is further defined by at least one string catch.

3. The device of claim 2, wherein the pitch changer is housed within a pitch changer housing and retained within the pitch changer housing via a retaining rod that is disposed in a slot of the pitch changer.

4. The device of claim 3, wherein the lowering lever and raise lever are mechanically coupled to a pitch changer rod.

5. The device of claim 4, wherein the pitch changer rod is mechanically coupled to a bell crank.

6. The device of claim 5, wherein the pitch changer rod features a nylon tuning screw.

7. The device of claim 6, wherein the compression spring extends from a cross bar of a frame, whereby the lowering lever has a rest position against a stop bar of the assembly housing.

8. A pitch changer comprising: a lowering lever with a pivot groove; and, a raiser lever, wherein said lowering lever and raiser lever are pivotally coupled via a pivot pin, wherein said raiser lever is mechanically coupled to one of at least two bell cranks so that depressing one of at least two pedals causes the raiser lever to pivot around the pivot pin, and wherein said lowering lever is mechanically coupled to the other bell crank so that depressing the other pedal causes the lowering lever to pivot around one end of a pivot plate in the pivot groove, whereby string(s) may be raised and/or lowered; and a compression spring that is mechanically coupled to a lowering lever for adjusting tautness of a musical instrument string, wherein the compression spring extends from a cross bar to a frame, wherein the compression spring resists movements of the lowering lever by compressing when the lowering lever is pivoted around said end of the pivot plate to lower a pitch of a string.

9. A pitch changer comprising:

a lowering lever with a pivot groove; and, a raiser lever, wherein said lowering lever and raiser lever are pivotally coupled via a pivot pin, wherein said raiser lever is mechanically coupled to one of at least two bell cranks so that depressing one of at least two pedals causes the raiser lever to pivot around the pivot pin, and wherein said lowering lever is mechanically coupled to the other bell crank so that depressing the other pedal causes the lowering lever to pivot around one end of a pivot plate in the pivot groove, whereby string(s) may be raised and/or lowered; wherein the lowering lever is coupled to a compression spring so that the compression spring compresses when the lowering lever is pivoted around said end of the pivot plate to lower a pitch of a string.

10. The pitch changer of claim 9 further defined by at least one string catch.

11. The pitch changer of claim 10 wherein the pitch changer is housed within a pitch changer housing and retained within the pitch changer housing via a retaining rod that is disposed in a slot of the pitch changer, wherein the lower lever and raiser lever are mechanically coupled to a pitch changer rod that is mechanically coupled to a bell crank.

12. A pitch changer comprising: a lowering lever with a pivot groove; and, a raiser lever, wherein said lowering lever and raiser lever are pivotally coupled via a pivot pin, wherein said raiser lever is mechanically coupled to one of at least two bell cranks so that depressing one of at least two pedals causes the raiser lever to pivot around the pivot pin, and wherein said lowering lever is mechanically coupled to the other bell crank so that depressing the other pedal causes the lowering lever to pivot around one end of a pivot plate in the pivot groove, whereby string(s) may be raised and/or lowered; and further comprising:

(a) a low string catch; and, (b) a high string catch, wherein the pitch changer is coupled to a stop plate, wherein a compression spring pushes the pitch changer against the stop plate when a pull is released, whereby if a string is in the low string catch a tension of the string is reduced when pulling the pitch changer and if the string is in the high string catch the tension of the string is increased when pulling the pitch changer; wherein the lowering lever is coupled to a compression spring so that the compression spring compresses when the lowering lever is pivoted around said end of the pivot plate to lower a pitch of a string.

13. The pitch changer of claim 12 wherein the pitch changer is housed within a pitch changer housing and retained within the pitch changer housing via a retaining rod that is disposed in a slot of the pitch changer.

* * * * *